US009494299B2

(12) United States Patent
Chang

(10) Patent No.: US 9,494,299 B2
(45) Date of Patent: Nov. 15, 2016

(54) HIGH-EFFICIENCY LED ILLUMINATOR WITH IMPROVED BEAM QUALITY AND VENTILATED HOUSING

(71) Applicant: General Scientific Corporation, Ann Arbor, MI (US)

(72) Inventor: Byung J. Chang, Ann Arbor, MI (US)

(73) Assignee: General Scientific Corporation, Ann Arbor, MI (US)

( * ) Notice: Subject to any disclaimer, the term of this patent is extended or adjusted under 35 U.S.C. 154(b) by 307 days.

(21) Appl. No.: 14/302,918

(22) Filed: Jun. 12, 2014

(65) Prior Publication Data

US 2014/0293588 A1 Oct. 2, 2014

Related U.S. Application Data

(63) Continuation-in-part of application No. 14/195,505, filed on Mar. 3, 2014, now Pat. No. 9,383,077, which
(Continued)

(51) Int. Cl.

| | |
|---|---|
| ***F21V 5/00*** | (2015.01) |
| ***F21V 13/04*** | (2006.01) |
| ***F21V 21/084*** | (2006.01) |
| ***F21V 5/04*** | (2006.01) |
| ***F21V 14/06*** | (2006.01) |
| ***F21V 21/088*** | (2006.01) |
| ***F21V 29/507*** | (2015.01) |
| ***F21V 29/83*** | (2015.01) |
| *F21V 14/02* | (2006.01) |
| *F21V 21/30* | (2006.01) |

(Continued)

(52) U.S. Cl.

CPC ..... *F21V 13/04* (2013.01); *F21V 5/008* (2013.01); *F21V 5/048* (2013.01); *F21V 14/025* (2013.01); *F21V 14/06* (2013.01); *F21V 14/065* (2013.01); *F21V 21/084* (2013.01); *F21V 21/0885* (2013.01); *F21V 29/507* (2015.01); *F21V 29/83* (2015.01); *F21V 14/02* (2013.01); *F21V 21/30* (2013.01); *F21W 2131/202* (2013.01); *F21W 2131/205* (2013.01); *F21Y 2101/02* (2013.01)

(58) Field of Classification Search

CPC ..... F21V 21/084; F21V 21/0885; F21V 21/406; F21V 5/008; A61B 1/0684; A61B 1/0692

See application file for complete search history.

(56) References Cited

U.S. PATENT DOCUMENTS

| | | | |
|---|---|---|---|
| 3,745,993 | A | 7/1973 | Feinbloom |
| 5,042,048 | A | 8/1991 | Meyer |

(Continued)

*Primary Examiner* — Andrew Coughlin

(74) *Attorney, Agent, or Firm* — Dinsmore & Shohl LLP

(57) ABSTRACT

An improved illuminator with an adjustable beam pattern to be worn by medical and dental professionals includes a housing, a light-emitting diode (LED) disposed in the housing outputting light through a distal opening in the housing, an achromatic doublet lens mounted in the opening in the housing, and a singlet lens disposed between the LED and the achromatic lens. The distance between the singlet lens and the doublet lens may be adjustable, and/or distance between the LED and the singlet lens may be adjustable, through a threaded connections, for example. In the preferred embodiment, the achromatic doublet lens, the singlet lens, or both the singlet and the doublet lens have a planar surface. A conical mirror may be disposed between the LED and the singlet lens to increase the light collection efficiency of the LED.

20 Claims, 7 Drawing Sheets

Related U.S. Application Data is a continuation-in-part of application No. 13/216,866, filed on Aug. 24, 2011, now Pat. No. 8,662,709, which is a continuation-in-part of application No. 12/623,470, filed on Nov. 23, 2009, now Pat. No. 8,047,684.

(51) Int. Cl.

| | |
|---|---|
| *F21W 131/202* | (2006.01) |
| *F21W 131/205* | (2006.01) |
| *F21Y 101/02* | (2006.01) |

(56) References Cited

U.S. PATENT DOCUMENTS

| | | | |
|---|---|---|---|
| 5,331,357 | A | 7/1994 | Cooley et al. |
| 5,924,234 | A | 7/1999 | Bindon et al. |
| 6,290,368 | B1 | 9/2001 | Lehrer |
| 7,066,622 | B2 | 6/2006 | Alessio |
| 9,052,455 | B2 | 6/2015 | Chang |
| 2003/0038928 | A1 | 2/2003 | Alden |
| 2007/0217198 | A1 | 9/2007 | Alessio |
| 2008/0019011 | A1 | 1/2008 | Krneta et al. |
| 2009/0059095 | A1 | 3/2009 | Hall, Jr. et al. |
| 2009/0161348 | A1 | 6/2009 | Spartano et al. |
| 2011/0122598 | A1 | 5/2011 | Chang |

HIGH-EFFICIENCY LED ILLUMINATOR WITH IMPROVED BEAM QUALITY AND VENTILATED HOUSING

REFERENCE TO RELATED APPLICATIONS

This application is a continuation-in-part of U.S. patent application Ser. No. 14/195,505, filed Mar. 3, 2014, which is a continuation-in-part of U.S. patent application Ser. No. 13/216,866, filed Aug. 24, 2011, now U.S. Pat. No. 8,662,709, which is a continuation-in-part of U.S. patent application Ser. No. 12/623,470, filed Nov. 23, 2009, now U.S. Pat. No. 8,047,684. The entire content of all of which is incorporated herein by reference.

FIELD OF THE INVENTION

This invention relates generally to illuminators of the type worn by medical and dental professionals and, in particular, to an LED illuminator with multiple optical elements to improve beam quality

BACKGROUND OF THE INVENTION

The light generated by existing light-emitting diode (LED) illuminators is quite poor. Current illuminators of this kind use reflecting optical elements or singlet or multiple lenses with reflecting optical elements. An example is shown in U.S. Pat. No. 3,745,993 entitled "Surgical Headlight." Although this design discloses an achromatic lens, the light delivered to it from an optical fiber is reflected off of a mirror. As such, this and other existing configurations exhibit poor light uniformity and/or unacceptable color separation at the edge of beam.

SUMMARY OF INVENTION

This invention improves upon existing designs by providing an illuminator with an adjustable beam pattern to be worn by medical and dental professionals. The preferred embodiments include a housing, a light-emitting diode (LED) disposed in the housing outputting light through a distal opening in the housing, an achromatic doublet lens mounted in the opening in the housing, and a singlet lens disposed between the LED and the achromatic lens.

The distance between the singlet lens and the doublet lens may be adjustable, and/or distance between the LED and the singlet lens may be adjustable, through threaded or sliding connections, for example. In the preferred embodiment, the achromatic doublet lens, the singlet lens, or both the singlet and the doublet lens have a planar surface. A conical mirror may optionally be disposed between the LED and the singlet lens to increase the light collection efficiency of the LED.

DETAILED DESCRIPTION OF THE INVENTION

This invention resides in an LED illuminator with multiple optical elements to improve beam quality. All embodiments include a housing with an LED source, a singlet lens supported in front of the LED, and an achromatic doublet lens in position where the light exits the housing. An attachment mechanism is coupled to the housing, enabling the illuminator to be worn as a headlamp.

Figure 1:
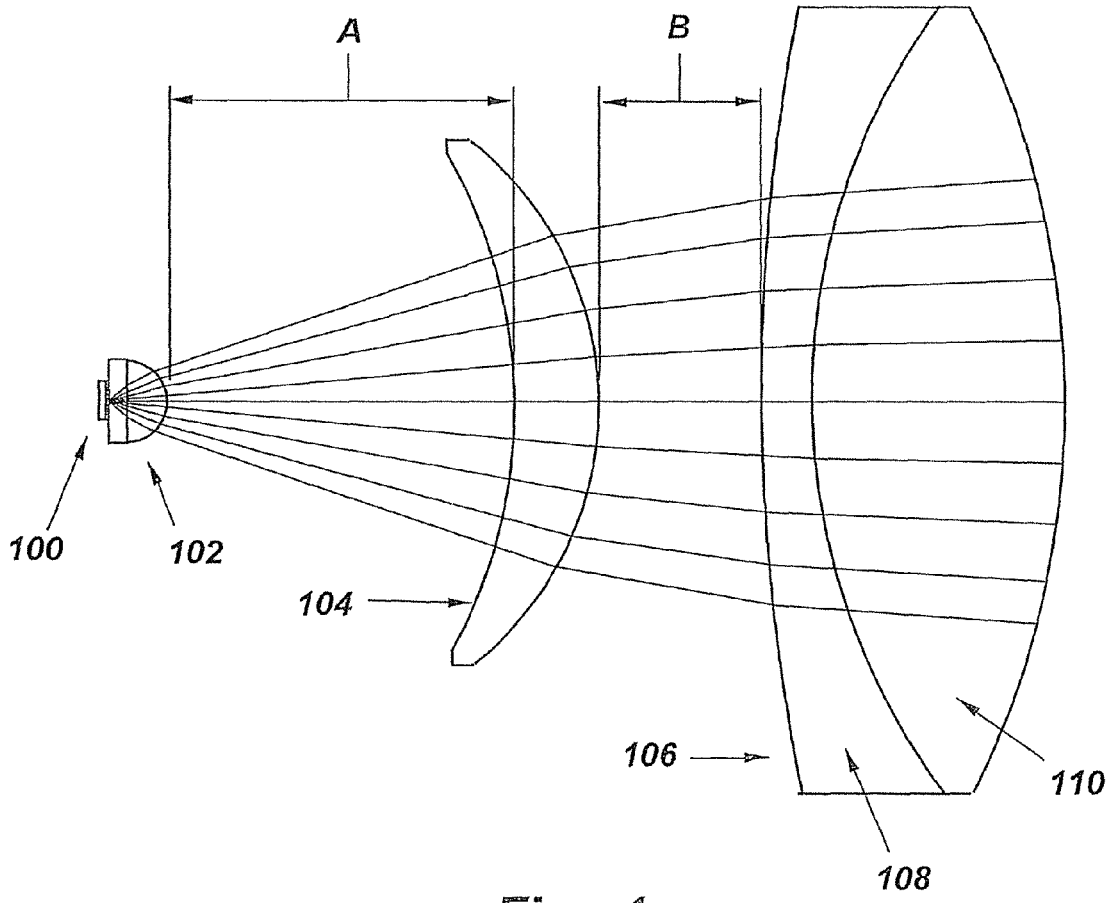
FIG. 1 is a cross section of an embodiment of the invention.

One embodiment, shown in FIG. 1, uses a singlet lens 104 and an achromatic doublet lens 106 made with one positive and one negative lens elements 108, 110. This and the other embodiments disclosed herein are based upon a high-intensity white-emitting LED 100 including an integral lens 102, which may be spherical.

One or both distances A, B in FIG. 1 can be either fixed or adjustable for beam pattern or different applications. For typical headlamp applications, A may be on the order of 6 mm, adjustable between 4 to 11 mm, while B may be on the order of 4 mm, adjustable between 2 to 6 mm or thereabouts. The diameter of the singlet 104 may be in the range of 7 to 10 mm, whereas the achromatic doublet lens 106 will be on the order of 17 to 20 mm, again for typical headlamp applications. The radius of the LED lens may be 2.5 mm+/−0.5 mm.

Figure 3:
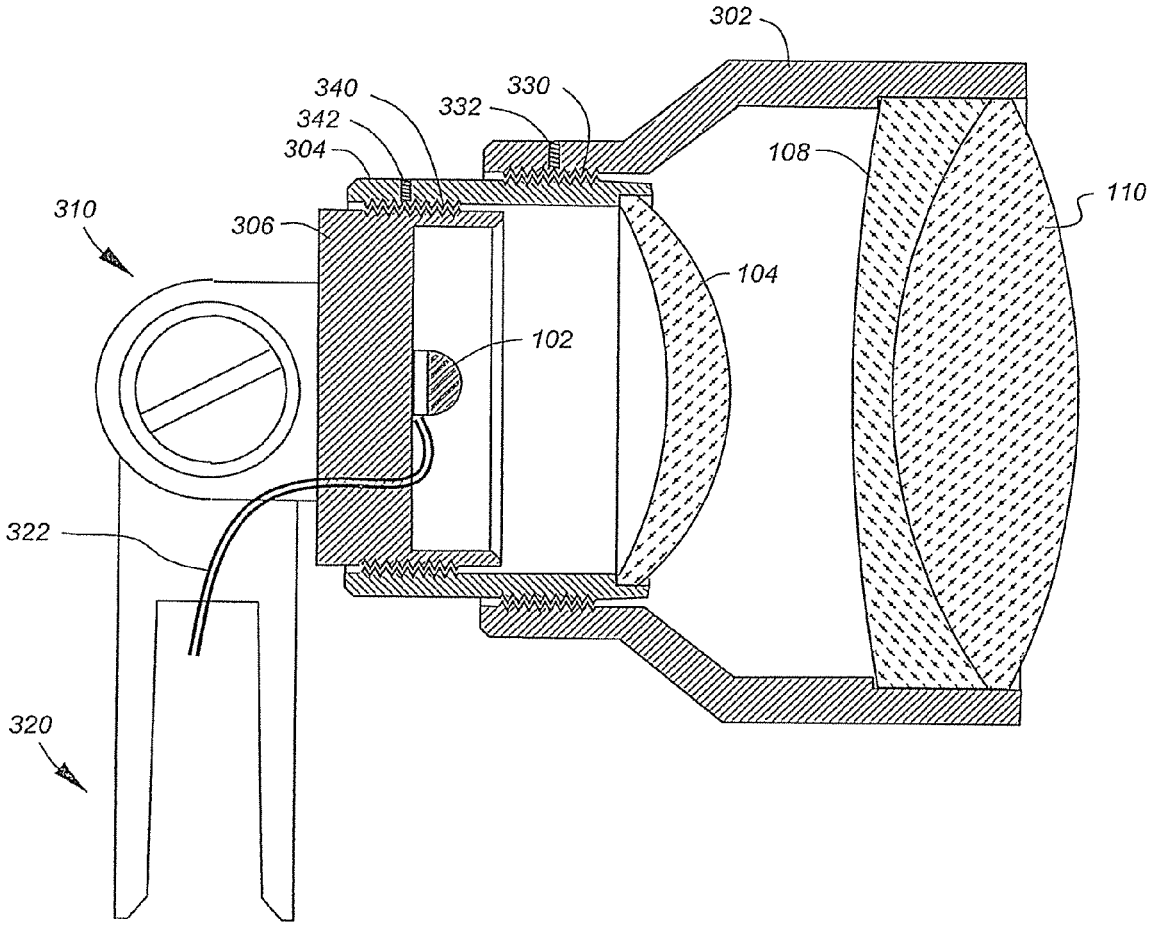
FIG. 3 is a drawing of a housing applicable to the present invention.

FIG. 3 shows a suitable housing for the preferred optical assembly. Doublet 108, 110, is disposed in a housing 302; singlet 104 is disposed in housing 304, and LED 102 is mounted within housing 306. The housings are coupled via threaded connections 330, 340, with set screws 332, 342 and/or an adhesive being used to fix the relative positions. If one or both distances are permanently fixed, one or both of the threaded connections 330, 340 may be eliminated, simplifying the housing overall.

The base housing 306 is preferably coupled to a clip-on type connector 320 through hinge 310. The invention is not limited in this regard insofar as other attachment mechanisms may be used. Any materials such as plastic, metal (i.e., aluminum) may be used for the housing pieces. Heat vents or sinks (not shown) may also be provided. The cord for the LED is depicted at 322.

Figure 2:
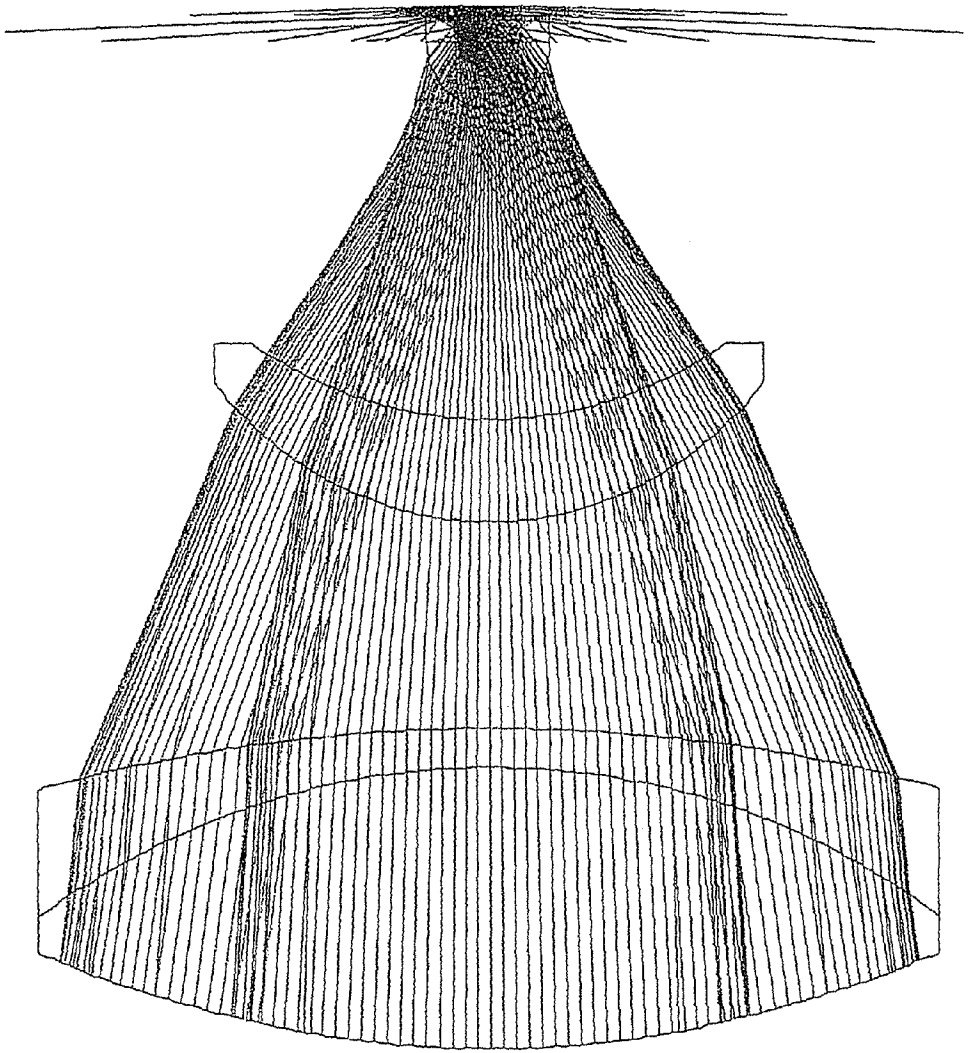
FIG. 2 is a ray-tracing diagram of the embodiment of FIG. 1.
Figure 4:
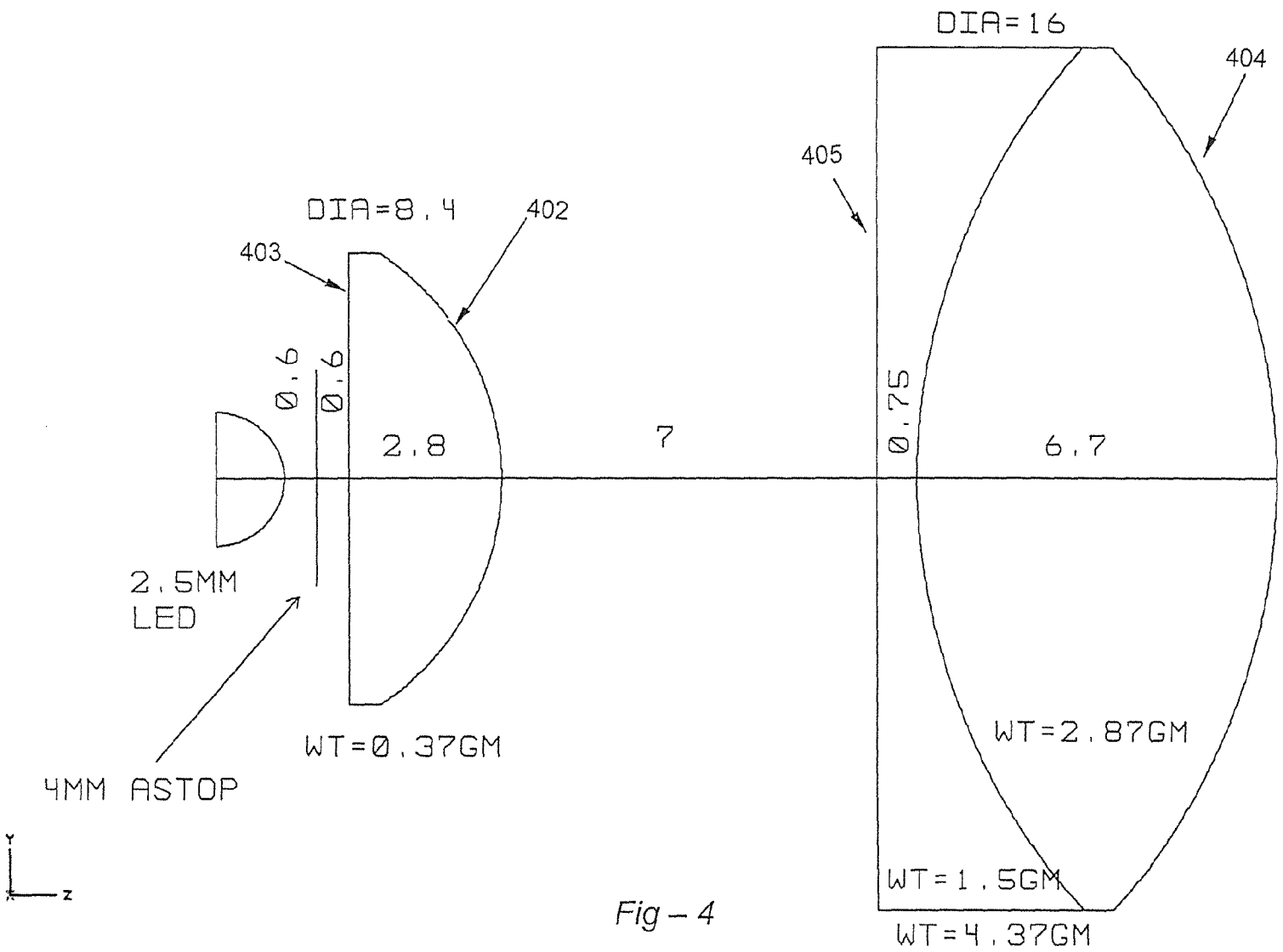
FIG. 4 is a cross section of a preferred embodiment of the invention.
Figure 5:
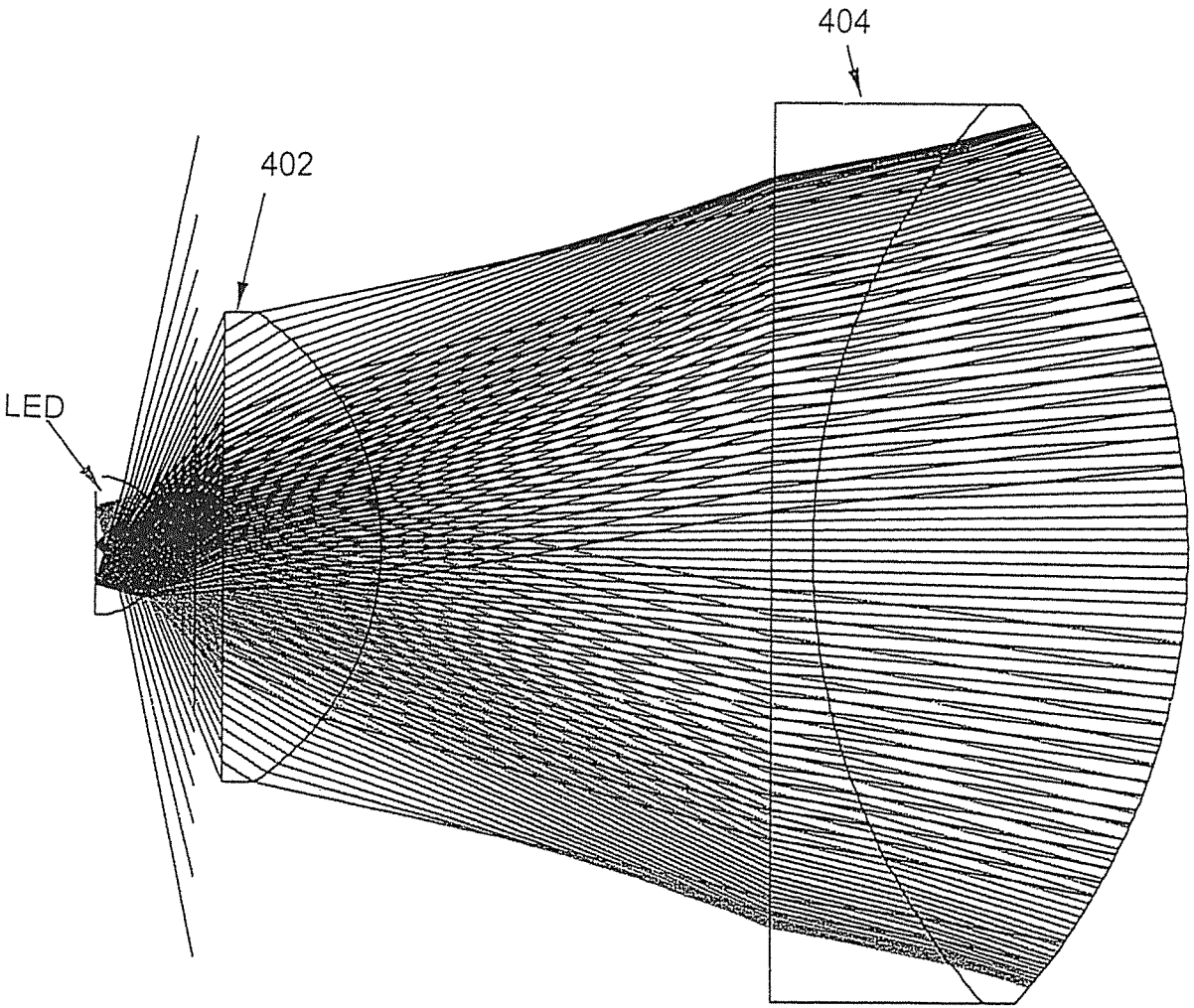
FIG. 5 is a ray-tracing diagram of the embodiment of FIG. 4.

FIG. 4 is a cross section of a preferred embodiment of the invention, and FIG. 5 is a ray-tracing diagram of the embodiment of FIG. 4. In this configuration, one or both of the singlet lens 402 and doublet lens 404 includes a planar surface (i.e., surfaces 403, 405), resulting in a configuration which is more compact that the embodiment of FIGS. 1, 2. FIG. 4 provides typical lens diameters, dimensions and weights for a medical/dental illuminator with the understanding that these values represent one combination of many. The optical elements of FIGS. 4, 5 would be mounted in a housing comparable to that shown in FIG. 3. An aperture stop (ASTOP) is optionally provided to beam pattern with a desired shape such as round.

Figure 6:
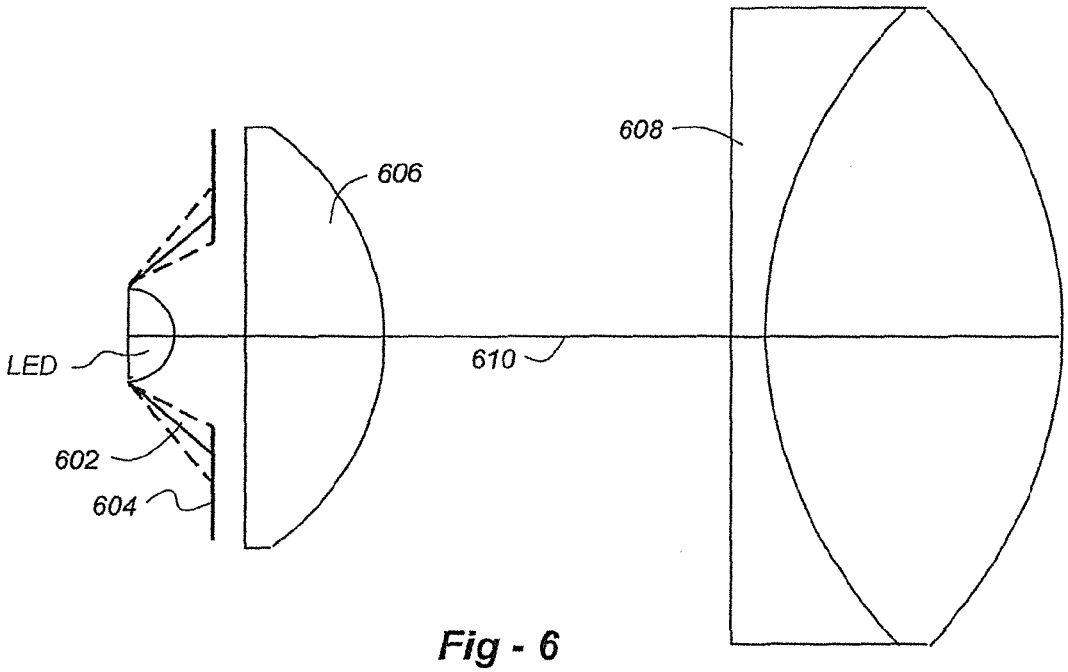
FIG. 6 is a cross section of an embodiment of the invention wherein a conical mirror is disposed between the LED and the singlet lens to increase the light collection efficiency of the LED.

FIG. 6 depicts an alternative embodiment of the invention including a conical mirror 602 added between the LED and aperture stop 604 to increase light collection efficiency from the LED. The axis of conical mirror 602 is preferably aligned with the overall optical axis 610 of the assembly. The geometry of the cone may be modified as shown with the broken lines depending upon the type of LED, lenses and desired optical characteristics.

As with the other embodiments disclosed herein, the optical components of FIG. 6 include a singlet lens 606 supported in front of the LED, and an achromatic doublet lens 608 in position where the light exits the housing. An attachment mechanism is coupled to the housing, enabling the illuminator to be worn as a headlamp. The distance between the singlet lens and the doublet lens may be adjustable, and/or distance between the LED and the singlet lens may be adjustable, through a threaded connections, for example.

Figure 7:
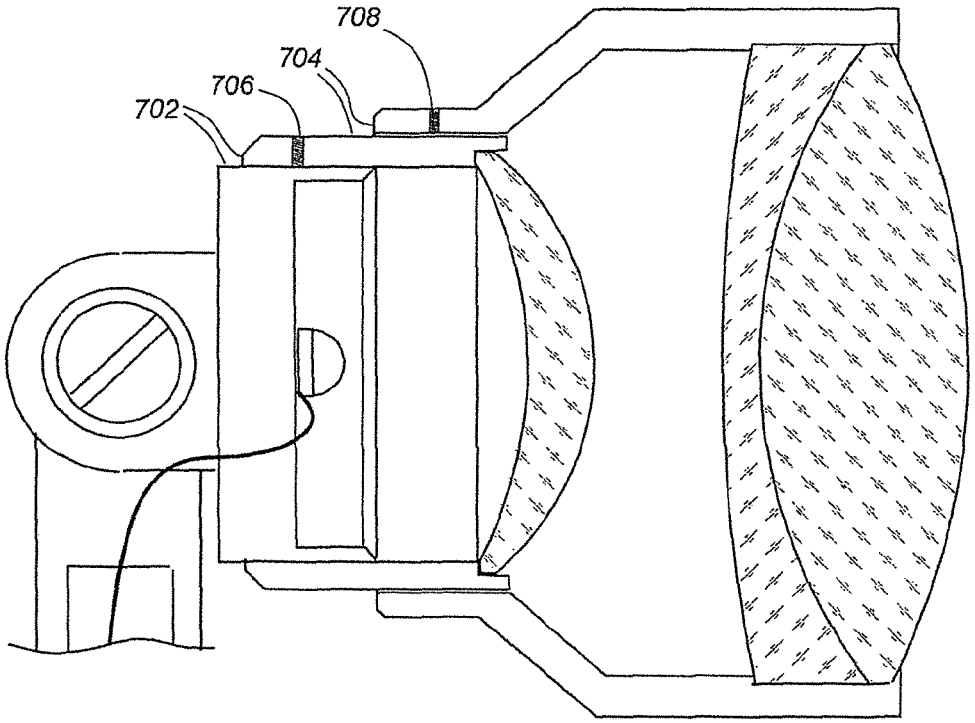
FIG. 7 is a cross section of a housing that uses sliding as opposed to threaded connections.

In the preferred embodiment, the achromatic doublet lens, the singlet lens, or both the singlet and the doublet lens have a planar surface, as shown. However, the invention is not limited in this regard, as the rear surfaces of singlet and/or doublet lenses can have either concave or convex surfaces. Nor should the drawings be considered to scale, as the sizes of the lenses and LEDs, as well as the separations between lenses can vary. The configurations may be scaled up for large LED chips, including the use of multiple LED chips. FIG. 7 is a cross section of an alternative housing that uses sliding surfaces 702, 704 with locking screws 706, 708 as opposed to threaded connections.

Figure 8:
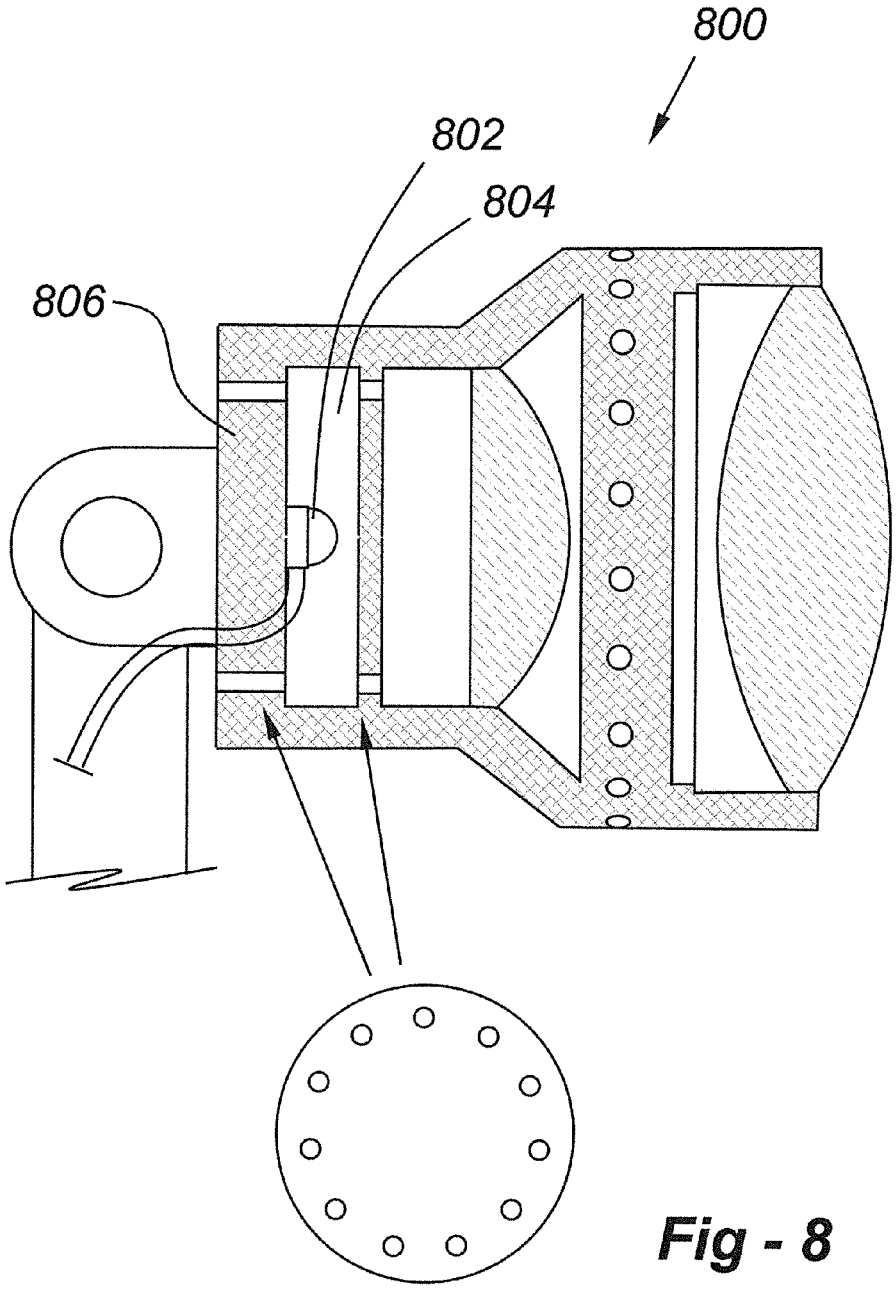
FIG. 8 is a drawing in partial cross-section showing possible ventilation structures.

FIG. 8 is a drawing in partial cross section illustrating an embodiment of the invention with possible ventilation structures. Although this embodiment may use screw or sliding adjustment mechanisms they have been left out for the sake of clarity. In this and other embodiments of the invention, LED 802 may be disposed in a separate compartment 804 within the body of the illuminator 800. As such the LED and compartment may become quite warm during operation. To alleviate this issue, ventilation holes may be provided in some or all of the following locations: (1) in the rear wall 806 of the LED cavity 804; (2) in the front wall 808 of the LED cavity; and/or the side wall 810 of the body of the device 800. The apertures would typically be drilled through the respective walls, assuming the device is constructed of aluminum.

I claim:

1. An illuminator of the type worn by medical and dental professionals, comprising:

a housing;

at least one light-emitting diodes (LED) disposed in a compartment within the housing, the LED outputting light through a distal opening in the housing;

an achromatic doublet lens mounted in the opening in the housing;

a singlet lens disposed between the LED and the achromatic lens;

an attachment mechanism coupled to the housing enabling the illuminator to be worn as a headlamp; and a plurality or ventilation holes formed in the compartment, the housing, or both to dissipate heat generated by the LED during use of the illuminator.

2. The illuminator of claim 1, further including a conical mirror disposed between the LED and the singlet lens to increase the light collection efficiency of the LED.

3. The illuminator of claim 1, wherein the achromatic doublet lens, the singlet lens, or both the singlet and the doublet lens have a planar surface.

4. The illuminator of claim 1, wherein the distance between the singlet lens and the doublet lens is adjustable through a threaded connection.

5. The illuminator of claim 1, wherein the distance between the singlet lens and the doublet lens is adjustable through a sliding connection.

6. The illuminator of claim 1, wherein the distance between the LED and the singlet lens is adjustable through a threaded connection.

7. The illuminator of claim 1, wherein the distance between the LED and the singlet lens is adjustable through a sliding connection.

8. The illuminator of claim 1, wherein:

the distance between the singlet lens and the doublet lens is adjustable through a threaded connection; and the distance between the LED and the singlet lens is adjustable through a different threaded connection.

9. The illuminator of claim 1, wherein:

the distance between the singlet lens and the doublet lens is adjustable through a sliding connection; and the distance between the LED and the singlet lens is adjustable through a different sliding connection.

10. The illuminator of claim 1, wherein the attachment mechanism is a clip-on connector.

11. The illuminator of claim 1, wherein the LED is a white LED.

12. The illuminator of claim 1, wherein the LED includes an integral lens.

13. The illuminator of claim 1, wherein the LED includes an integral spherical lens.

14. The illuminator of claim 1, wherein the output light has a non-collimated, divergent beam pattern.

15. The illuminator of claim 1, wherein:

the output light has a non-collimated, divergent beam pattern; and the beam pattern is adjustable through movement of one or both of the lenses.

16. An illuminator of the type worn by medical and dental professionals, comprising:

a housing having a distal opening;

at least one light-emitting diode (LED) disposed in a compartment within the housing;

an achromatic doublet lens mounted in the distal opening;

a singlet lens disposed in the housing between the LED and the achromatic lens;

a conical mirror disposed between the LED and the singlet lens to increase the light collection efficiency of the LED;

wherein the achromatic doublet lens, the singlet lens, or both the singlet and the doublet lens have a planar surface;

wherein the lenses output a non-collimated, divergent beam pattern;

an attachment mechanism coupled to the housing enabling the illuminator to be worn as a headlamp; and a plurality or ventilation holes formed in the compartment, the housing, or both to dissipate heat generated by the LED during use of the illuminator.

17. The illuminator of claim 16, wherein:

the distance between the singlet lens and the doublet lens is adjustable through a threaded or sliding connection; and the distance between the LED and the singlet lens is adjustable through a different threaded or sliding connection.

18. The illuminator of claim 16, wherein the attachment mechanism is a clip-on connector.

19. The illuminator of claim 16, wherein the LED is a white LED.

20. The illuminator of claim 16, wherein the LED includes an integral lens.

* * * * *